US010890019B2

(12) United States Patent
Lien

(10) Patent No.: US 10,890,019 B2
(45) Date of Patent: Jan. 12, 2021

(54) REVERSIBLE ELECTRIC DOOR LOCK

(71) Applicant: WFE TECHNOLOGY CORP., Taichung (TW)

(72) Inventor: Chih-Min Lien, Taichung (TW)

(73) Assignee: WFE Technology Corp., Taichung (TW)

( * ) Notice: Subject to any disclaimer, the term of this patent is extended or adjusted under 35 U.S.C. 154(b) by 672 days.

(21) Appl. No.: 15/791,643

(22) Filed: Oct. 24, 2017

(65) Prior Publication Data

US 2019/0119962 A1 Apr. 25, 2019

(51) Int. Cl.
*E05C 1/06* (2006.01)
*E05B 63/08* (2006.01)
(Continued)

(52) U.S. Cl.
CPC ..... *E05C 1/06* (2013.01); *E05B 63/0065* (2013.01); *E05B 63/08* (2013.01); *E05B 3/00* (2013.01)

(58) Field of Classification Search
CPC ..... E05C 1/06; E05C 1/12; E05C 1/16; E05B 3/00; E05B 3/08; E05B 15/006; E05B 17/044; E05B 47/0603; E05B 47/0657; E05B 63/04; E05B 63/044; E05B 47/0688; E05B 47/0676; E05B 47/0661; E05B 63/0065; E05B 63/042; E05B 63/08; E05B 47/068; E05B 47/0665; E05B 47/0684; E05B 47/0673; E05B 47/0692; E05B 47/0669; Y10S 292/24; Y10S 292/27; Y10S 292/30; Y10S 292/62; Y10S 70/42;
(Continued)

(56) References Cited

U.S. PATENT DOCUMENTS 5,640,863 A * 6/1997 Frolov ..... E05B 47/0692 70/149
6,053,019 A * 4/2000 Wiik ..... E05B 47/0673 70/283
(Continued)

FOREIGN PATENT DOCUMENTS

CN 103758403 A * 4/2014

OTHER PUBLICATIONS

Machine Translation of CN 103758403 A, 2020, pp. 1-6 (Year: 2020).*

*Primary Examiner* — Christine M Mills
(74) *Attorney, Agent, or Firm* — Michael Best & Friedrich LLP

(57) ABSTRACT

A reversible electric door lock includes a clutch unit, a dead bolt unit and a handle unit. The clutch unit has an external driving member, two driving plates mounted at two sides of the external driving member, an internal driving member rotatably mounted in the external driving member, and a clutch pin movably disposed in the external driving member between an engaging position to allow synchronous rotation of the external and internal driving members, and a disengaged position to allow idle rotation of the internal driving member. The external driving member is rotated to actuate the dead bolt unit to switch to an unlatched position. The handle unit includes an internal operating handle coupled with one of the driving plates, and an external operating handle coupled with the internal driving member. The reversible electric door lock can be applied to left-hand and right-hand doors.

6 Claims, 13 Drawing Sheets

(51) Int. Cl.
*E05B 63/00* (2006.01)
*E05B 3/00* (2006.01)

(58) Field of Classification Search
CPC ..... Y10T 292/1021; Y10T 292/1016; Y10T 292/102; Y10T 292/1097; Y10T 292/1098; Y10T 292/57; Y10T 292/93; Y10T 292/96; Y10T 292/854; Y10T 292/876; Y10T 292/88; Y10T 70/5416; Y10T 70/8865
See application file for complete search history.

(56) References Cited

U.S. PATENT DOCUMENTS 6,145,353 A * 11/2000 Doucet ..... E05B 47/0692 70/149
6,286,347 B1 * 9/2001 Frolov ..... E05B 47/0692 192/71
6,354,121 B1 * 3/2002 Frolov ..... E05B 47/0692 292/144
6,543,264 B2 * 4/2003 Frolov ..... E05B 13/005 70/106
6,619,705 B2 * 9/2003 Dalsing ..... E05B 55/06 292/169.14
6,651,468 B2 * 11/2003 Aramburu ..... E05B 13/005 70/189
6,837,081 B2 * 1/2005 Ruano Aramburu ..... E05B 47/0692 70/218
6,845,642 B2 * 1/2005 Imedio Ocana ..... E05B 47/068 70/222
7,155,945 B2 * 1/2007 Talpe, Jr. ..... E05B 47/0661 292/169.15
8,001,818 B2 * 8/2011 Imedio Ocana .... E05B 47/0692 70/472
8,079,238 B2 * 12/2011 Lin ..... E05B 65/1086 70/107
8,261,584 B2 * 9/2012 Yang ..... E05B 63/044 70/107
8,555,685 B2 * 10/2013 Frolov ..... E05B 63/16 70/283
10,260,253 B2 * 4/2019 Moon ..... E05B 47/0692
2019/0323263 A1 * 10/2019 Kwon ..... E05B 9/04
2019/0383060 A1 * 12/2019 Lien ..... E05B 59/00
2020/0032551 A1 * 1/2020 Holmes ..... E05B 47/0692
2020/0080343 A1 * 3/2020 Uyeda ..... E05B 47/0692

* cited by examiner

REVERSIBLE ELECTRIC DOOR LOCK

FIELD

The disclosure relates to an electric door lock, and more particularly to a reversible electric door lock adapted for a left-hand door and a right-hand door.

BACKGROUND

Referring to FIGS. 1 to 3, a conventional electric door lock includes a housing unit 11, a cam unit 12, a dead bolt unit 13, a handle unit 14 and an electric driving unit 15. The cam unit 12 has internal and external cam members 121, 122 disposed in the housing unit 11 and coaxial with and spaced apart from each other. The external cam member 122 has a latch slot 133. The dead bolt unit 13 has a dead bolt 132 and a transmitting module 131 coupled with the internal and external cam members 121, 122 to transmit a torque generated as a result of rotation of either the internal or external cam member 121, 122 for moving the dead bolt 132. The handle unit 14 has internal and external handles 141, 142 respectively disposed at interior and exterior of a door panel (not shown), and operated to respectively make the rotations of the internal and external cam members 121, 122. The electric driving unit 15 has a latch 152 movable to be engaged in the latch slot 133, and an actuating module 151 disposed to actuate the movement of the latch 152. In an unlatched position where the latch 152 is disengaged from the latch slot 133, each of the internal and external handles 141, 142 is allowed to be operated to rotate the respective cam member 121, 122 so as to retract the dead bolt 132 into the housing unit 11 to open the electric door lock. In a latched position where the latch 152 is driven by the actuating module 151 to be engaged in the latch slot 133, the rotation of the external handle 142 and the external cam member 122 is restricted to prevent opening the door lock from outside of the door panel.

With the internal and external cam members 121, 122 respectively coupled with the internal and external handles 141, 142 to rotate in a fixed rotational direction, the conventional electric door lock cannot be applied to both a left-hand door and a right-hand door, which results in inconvenience to use.

SUMMARY

Therefore, an object of the disclosure is to provide a reversible electric door lock that can alleviate at least one of the drawbacks of the prior art.

According to the disclosure, the reversible electric door lock includes a housing unit, a clutch unit, a dead bolt unit, a handle unit and an electric driving unit. The housing unit has first and second base plates spaced apart from each other in an axial direction to define a receiving space therebetween, and a lock plate disposed normal to the first and second base plates and interconnecting lateral sides of the first and second base plates. The first and second base plates respectively have first and second through holes which are aligned with each other in the axial direction. The lock plate has a bolt hole. The clutch unit has an external driving member which is disposed in the receiving space and rotatable relative to the housing unit about an axis that extends through the first and second through holes and in the axial direction and which has two mounting sides that are opposite to each other along the axis, two driving plates which are respectively mounted on the mounting sides of the external driving member and each of which has a pivot portion that is rotatably disposed in a respective one of the first and second through holes, and an internal driving member which is disposed in and rotatable relative to the external driving member about the axis. Each of the driving plates has an external spline hole which extends therethrough along the axis. The internal driving member has an internal spline hole which extends therethrough along the axis and which has a cross-section less than that of the external spline hole. The clutch unit further has a clutch pin which is disposed in and movable radially relative to the external driving member between an engaged position, where the clutch pin is engaged with the internal driving member so as to allow synchronous rotation of the external driving member with the internal driving member, and a disengaged position, where the clutch pin is disengaged from the internal driving member so as to allow an idle rotation of the internal driving member relative to the external driving member. The dead bolt unit has a dead bolt member which is disposed in the receiving space and movable through the bolt hole, and a transmitting module which is disposed to transmit a torque generated as a result of rotation of the external driving member to move the dead bolt member. The handle unit includes an internal operating handle and an external operating handle. The internal operating handle has an internal driving section which is configured to be in spline engagement with the external spline hole of one of the driving plates so as to rotate the one of the driving plates about the axis, and an operating section which is connected with the internal driving section to be manually operable. The external operating handle has an external driving section which is configured to extend through the external spline hole of the other one of the driving plates and to be in spline engagement with the internal spline hole of the internal driving member so as to rotate the internal driving member about the axis, and an operating section which is connected with the external driving section to be manually operable. The electric driving unit has a motor which is disposed in the receiving space, and an actuating member which is driven by the motor to actuate movement of the clutch pin between the engaged and disengaged positions.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
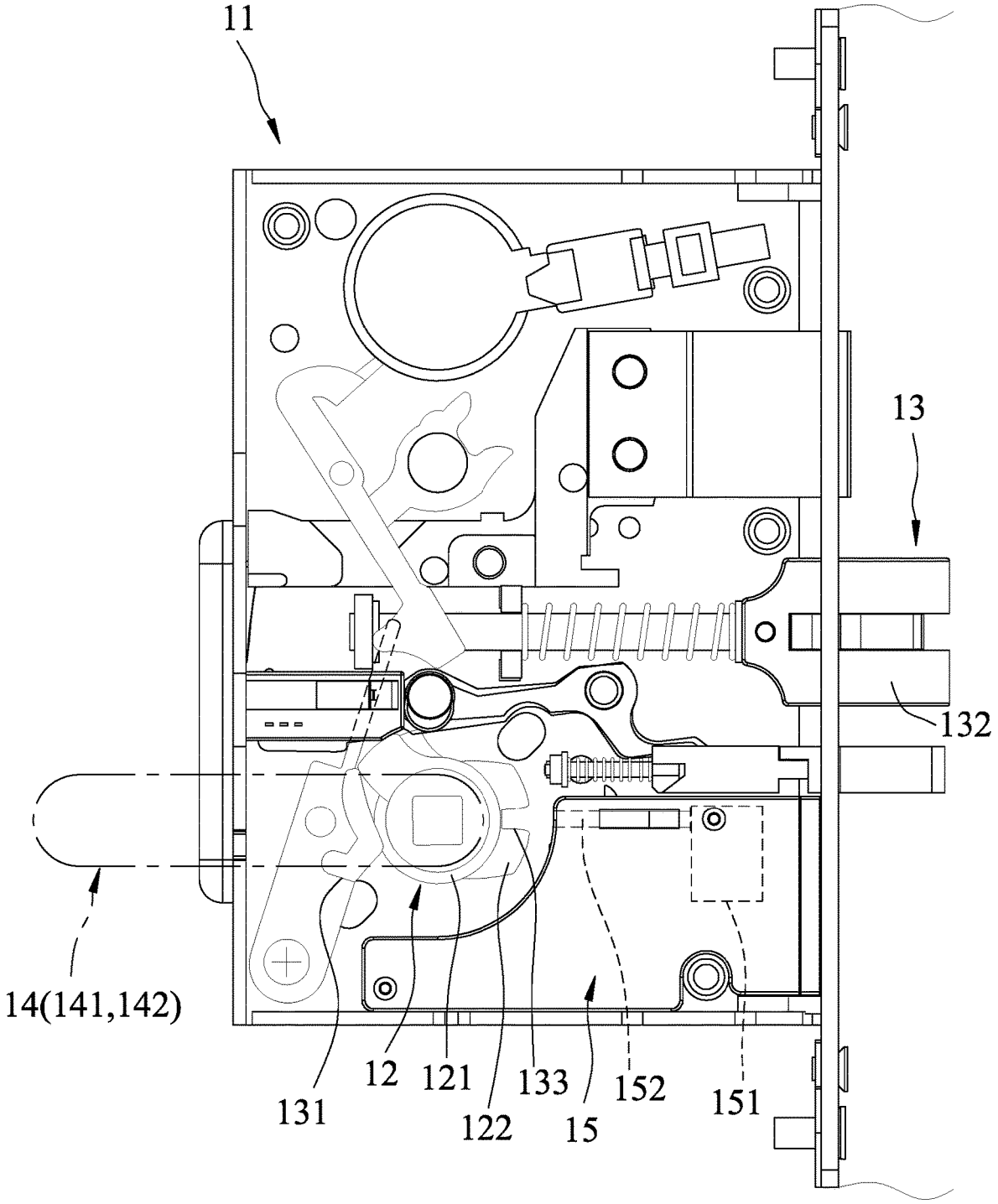
FIG.1 PRIOR ART
FIG. 1 is a schematic view illustrating a conventional electric door lock in a state when a dead bolt is in a latched position.
Figure 2:
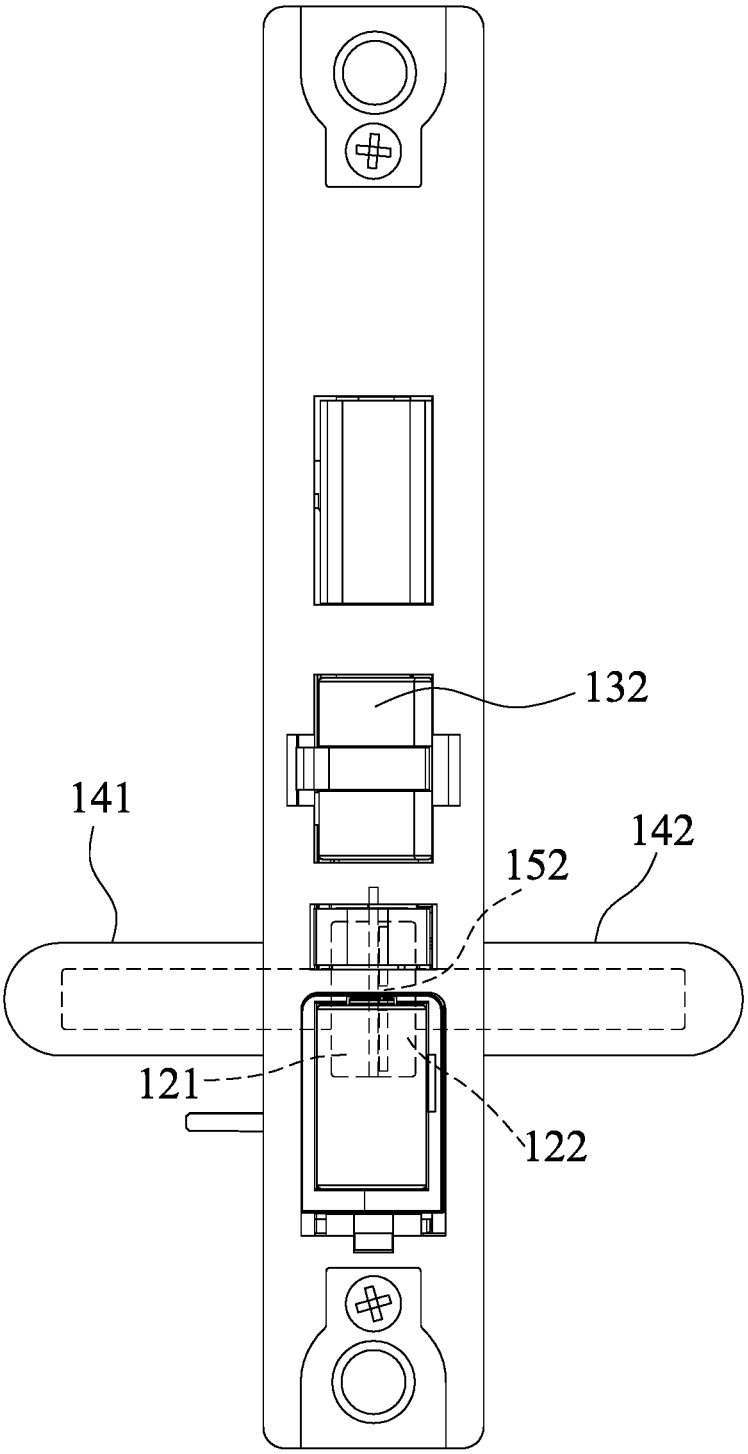
FIG.2 PRIOR ART
FIG. 2 is a side view of the conventional electric door lock.
Figure 3:
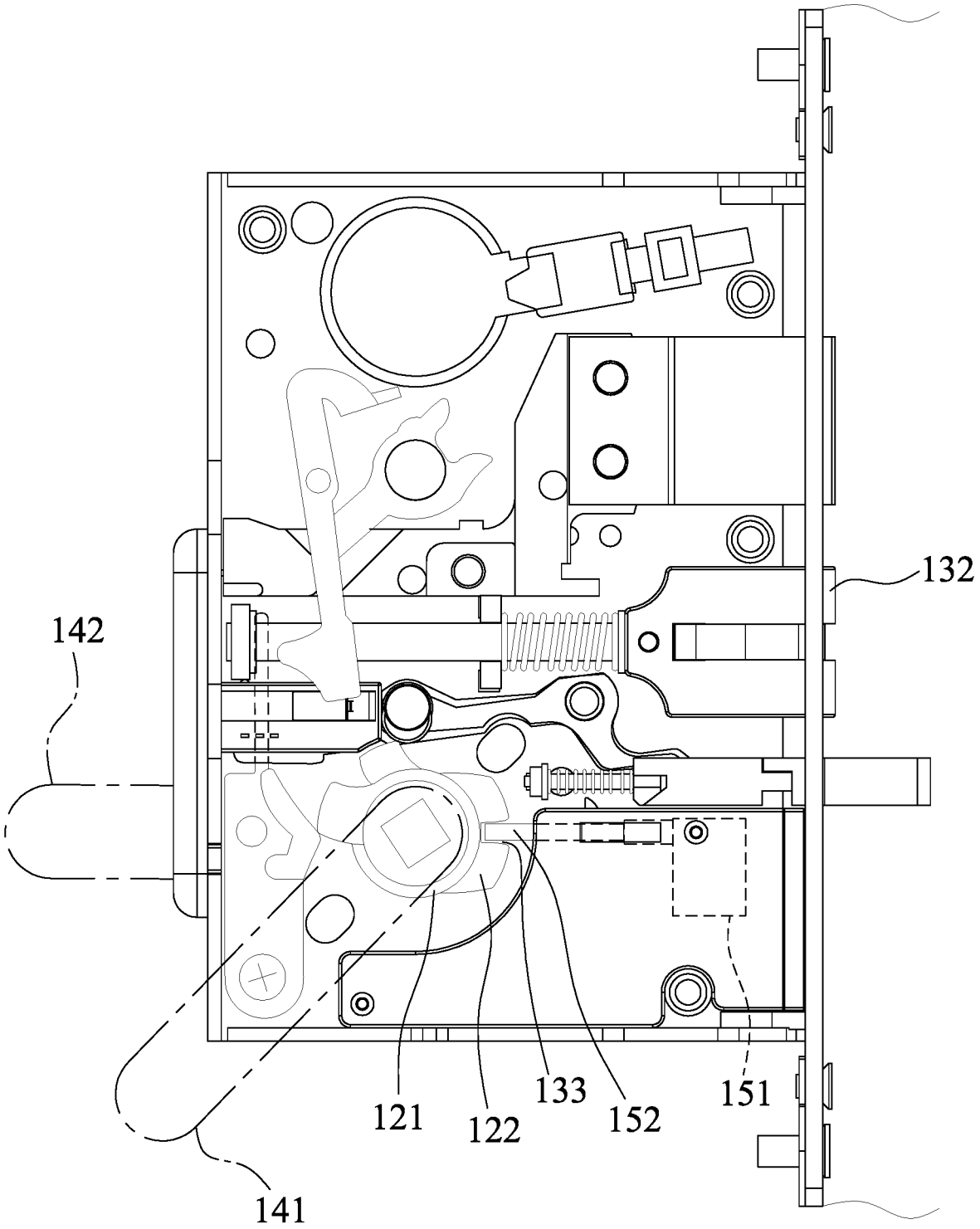
FIG.3 PRIOR ART
FIG. 3 is a schematic view illustrating the conventional electric door lock in a state when the dead bolt is in an unlatched position.
Figure 4:
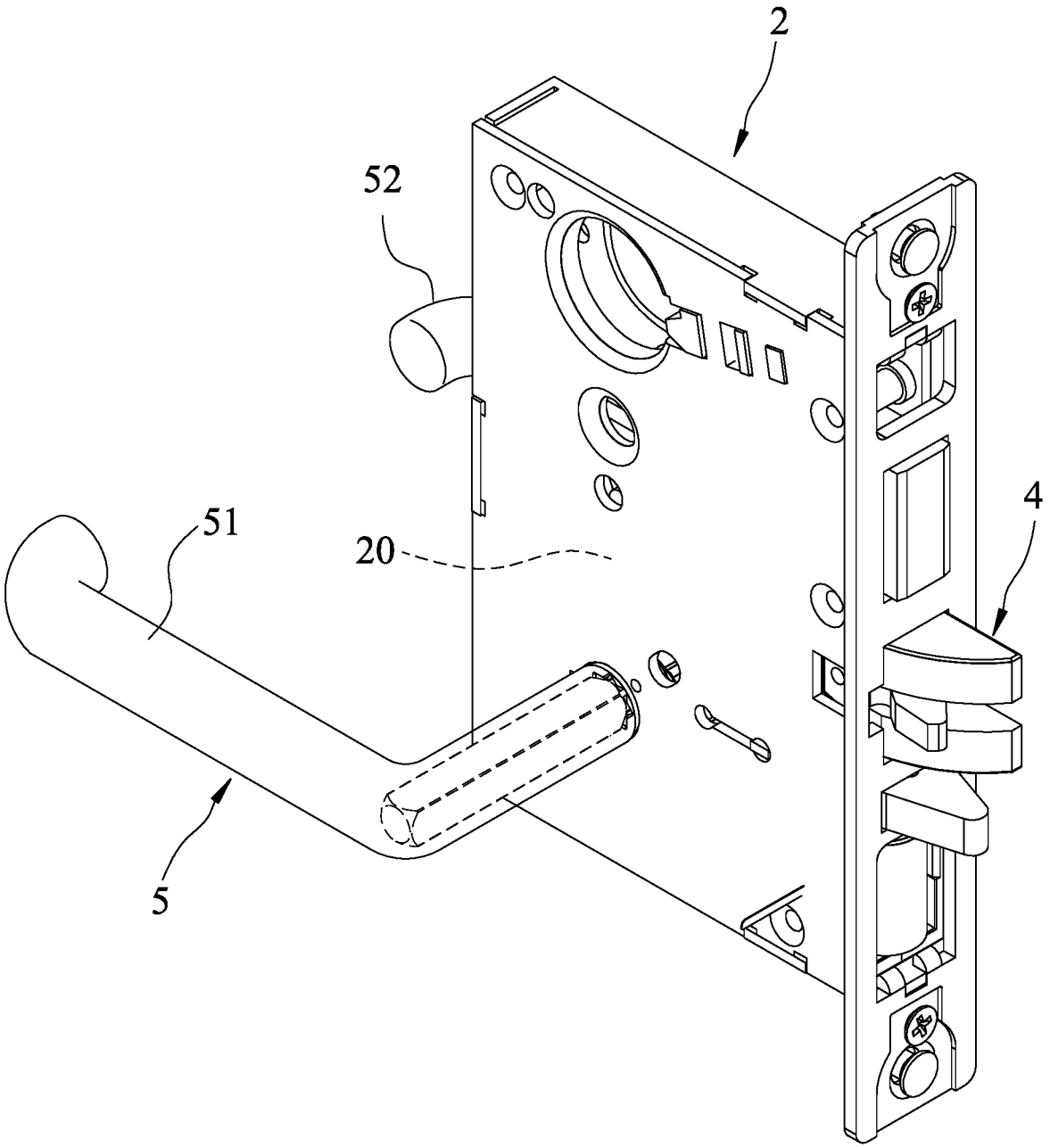
FIG. 4 is a perspective view illustrating an embodiment of a reversible electric door lock according to the disclosure.
Figure 5:
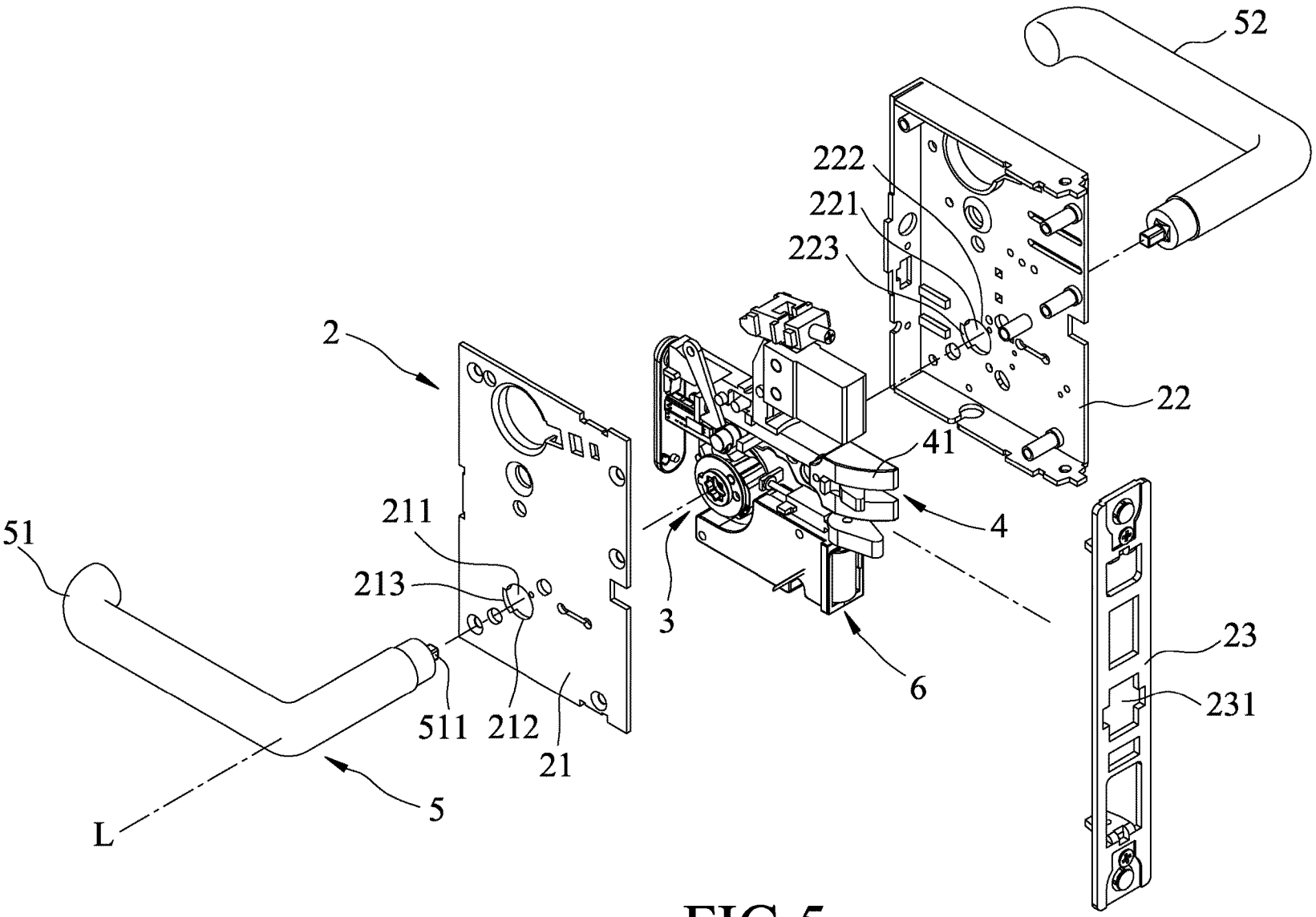
FIG. 5 is an exploded perspective view of the embodiment.
Figure 6:
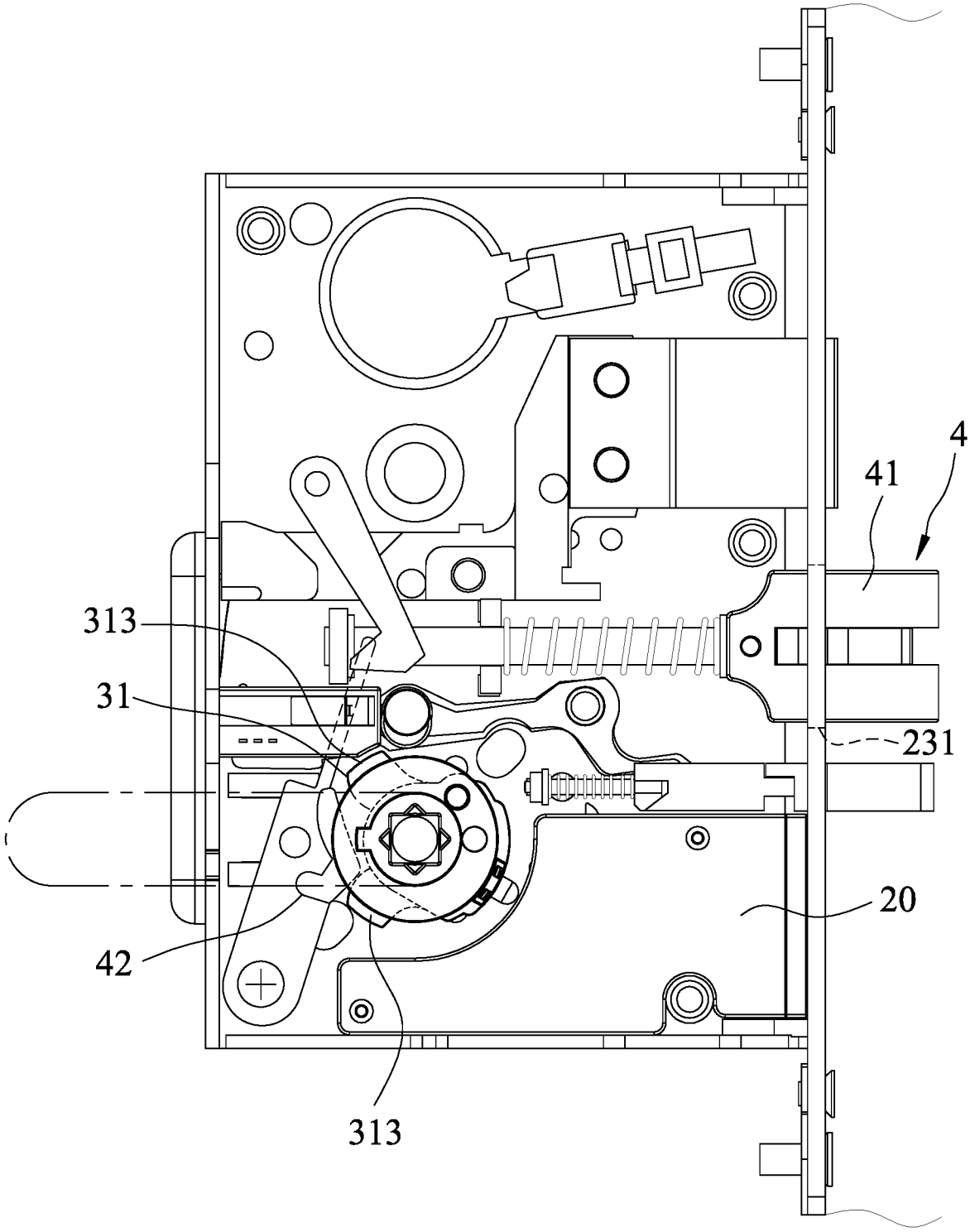
FIG. 6 is a schematic view illustrating the embodiment in a state when a dead bolt member is in a latched position.

Referring to FIGS. 4 to 6, an embodiment of a reversible electric door lock according to the disclosure includes a housing unit 2, a clutch unit 3, a dead bolt unit 4, a handle unit 5 and an electric driving unit 6.

The housing unit 2 has first and second base plates 21, 22 spaced apart from each other in an axial direction to define a receiving space 20 therebetween, and a lock plate 23 disposed normal to the first and second base plates 21, 22 and interconnecting lateral sides of the first and second base plates 21, 22. The first and second base plates 21, 22 respectively have first and second through holes 211, 221 which are aligned with each other in the axial direction. The lock plate having a bolt hole 231. Specifically, the first base plate 21 has a first inner circular wall 212 which surrounds an axis (L) in the axial direction to define the first through hole 211, and a first recessed portion 213 which is recessed radially from the first inner circular wall 212 and which extends around the axis (L) to terminate at two stop ends. The second base plate 22 has a second inner circular wall 222 which surrounds the axis (L) to define the second through hole 221, and a second recessed portion 223 which is recessed radially from the second inner circular wall 222 and which extends around the axis (L) to terminate at two stop ends. The first and second recessed portions 213, 223 are aligned with each other in the axial direction.

Figure 7:
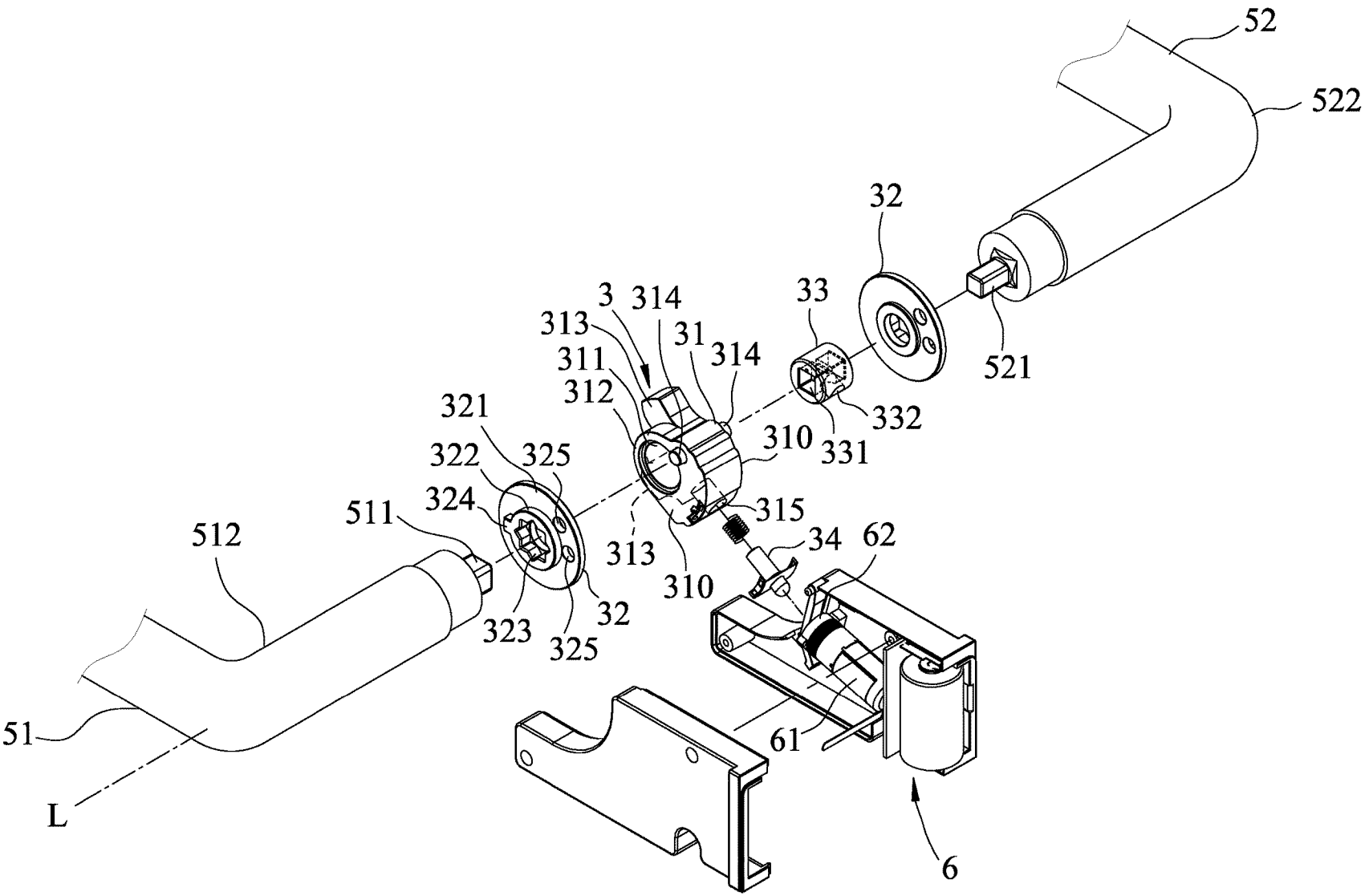
FIG. 7 is a fragmentary, exploded perspective view illustrating a clutch unit, a handle unit and an electric driving unit of the embodiment.

With reference to FIGS. 5 to 7, the clutch unit 3 has an external driving member 31 which is disposed in the receiving space 20 and rotatable relative to the housing unit 2 about the axis (L) and which has two mounting sides 310 that are opposite to each other along the axis (L), two driving plates 32 which are respectively mounted on the mounting sides 310 of the external driving member 31 and each of which has a pivot portion 322 that is rotatably disposed in a respective one of the first and second through holes 211, 221, and an internal driving member 33 which is disposed in and rotatable relative to the external driving member 31 about the axis (L).

The external driving member 31 has a surrounding wall 312 which is disposed between the mounting sides 310 and which surrounds the axis (L) to define an accommodation space 311 therein, two driving protrusions 313 which extend radially and outwardly from the surrounding wall 312 and which are angularly spaced apart from each other, and two engaging pins 314 which are telescopically disposed on the mounting sides 310, respectively, in the axial direction. The surrounding wall 312 has a communicating hole 315 extending radially to communicate the receiving space 20 with the accommodation space 311.

Each of the driving plates 32 is disposed to be adjustable relative to the external driving member 31 in a circumferential direction around the axis (L), and has a mounting portion 321 which is opposite to the pivot portion 322 in the axial direction and which is mounted on the respective mounting side 310 of the external driving member 31. Each driving plate 32 has an external spline hole 323 extending through the mounting and pivot portions 321, 322 along the axis (L), a limit portion 324 extending radially and outwardly from the pivot portion 322, and two adjusting holes 325 spaced apart from each other in the circumferential direction.

The pivot portion 322 of each driving plate 32 is rotatably and fittingly inserted into a respective one of the first and second inner circular walls 212, 222 to orient the rotation of the driving plate 32 about the axis (L) such that the limit portion 324 is slidable in a respective one of the first and second recessed portions 213, 223 between the stop ends. Each of the engaging pins 314 is telescopically engaged in a selected one of the adjusting holes 325 of the respective driving plate 32 so as to position the respective driving plate 32 to the external driving member 31. Hence, the rotatable angle of the external driving member 31 is predetermined and limited.

With reference to FIGS. 5, 7 to 9, the internal driving member 33 is disposed in the accommodation space 311 and is rotatable relative to the surrounding wall 312. The internal driving member 33 has an internal spline hole 331 which extends therethrough along the axis (L) and which has a cross-section less than that of the external spline hole 323, and a connecting hole 332 which extends radially to the internal spline hole 331 to be registered with the communicating hole 315 for defining a moving channel 35.

The clutch unit 30 further has a spring-biased clutch pin 34 which is disposed in and movable radially relative to the communicating hole 315 of the external driving member 31. The clutch pin 34 has a pin end movable in the moving channel 35 to be inserted into the connecting hole 332 for placing the clutch pin 34 in an engaged position, where the clutch pin 34 is engaged with the internal driving member 33 so as to allow synchronous rotation of the external driving member 31 with the internal driving member 33, and to be retreated in the communicating hole 315 for placing the clutch pin 34 in a disengaged position, where the clutch pin 34 is disengaged from the internal driving member 33 so as to allow an idle rotation of the internal driving member 33 relative to the external driving member 31.

With reference to FIGS. 5 to 7, the dead bolt unit 4 has a dead bolt member 41 which is disposed in the receiving space 20 and movable through the bolt hole 231, and a transmitting module 42 which is disposed to transmit a torque generated as a result of rotation of the external driving member 31 to move the dead bolt member 41. Specifically, the transmitting module 42 has an end coupled to the dead bolt member 41 to drive the movement, and an opposite end interposed between the driving protrusions 313 of the external driving member 31. With rotation of the external driving member 31, the corresponding driving protrusion 313 is engaged with the transmitting module 42 to transmit the torque so as to drive the movement of the dead bolt member 41.

Figure 8:
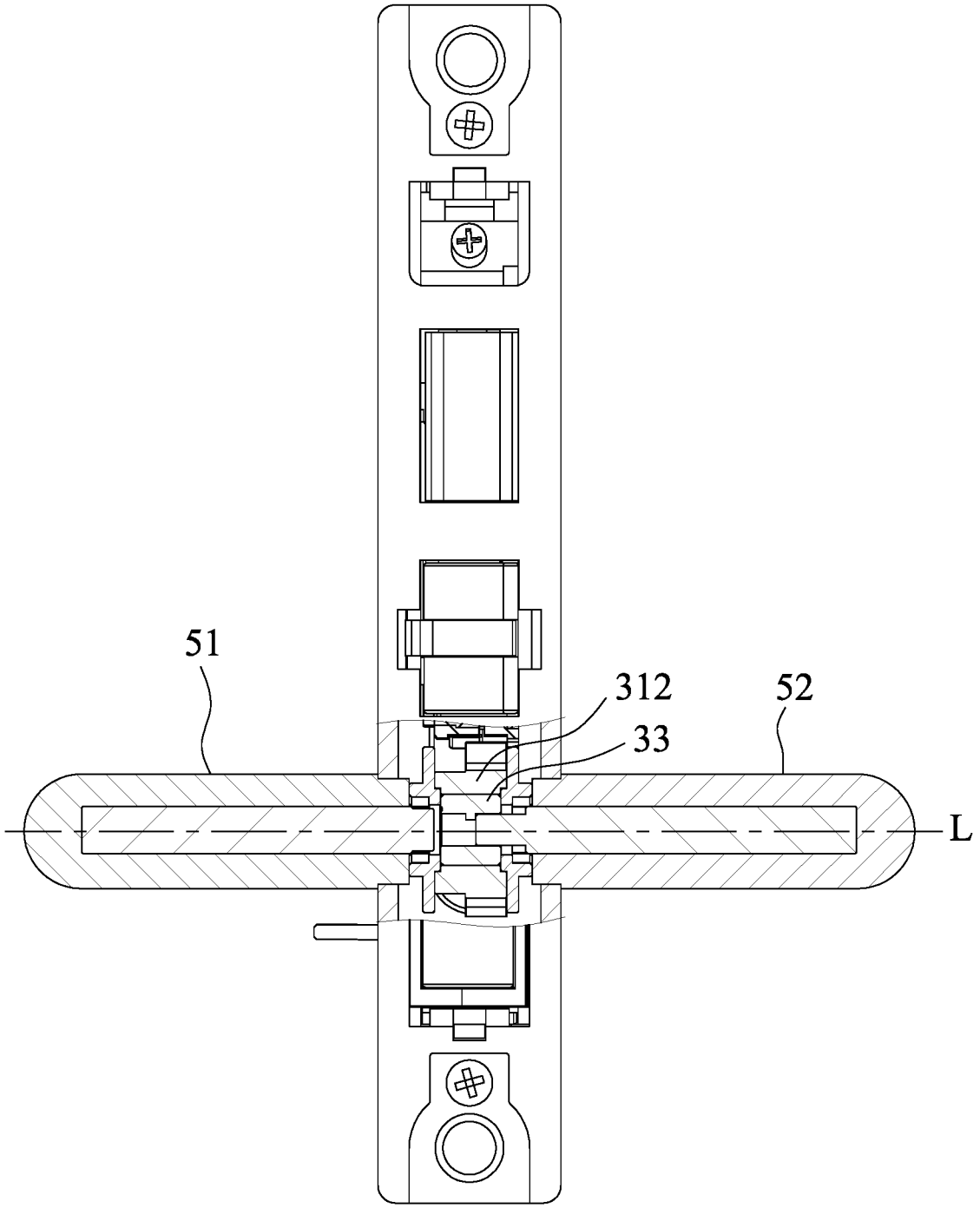
FIG. 8 is a fragmentary, partly sectional side view illustrating the embodiment.
Figure 9:
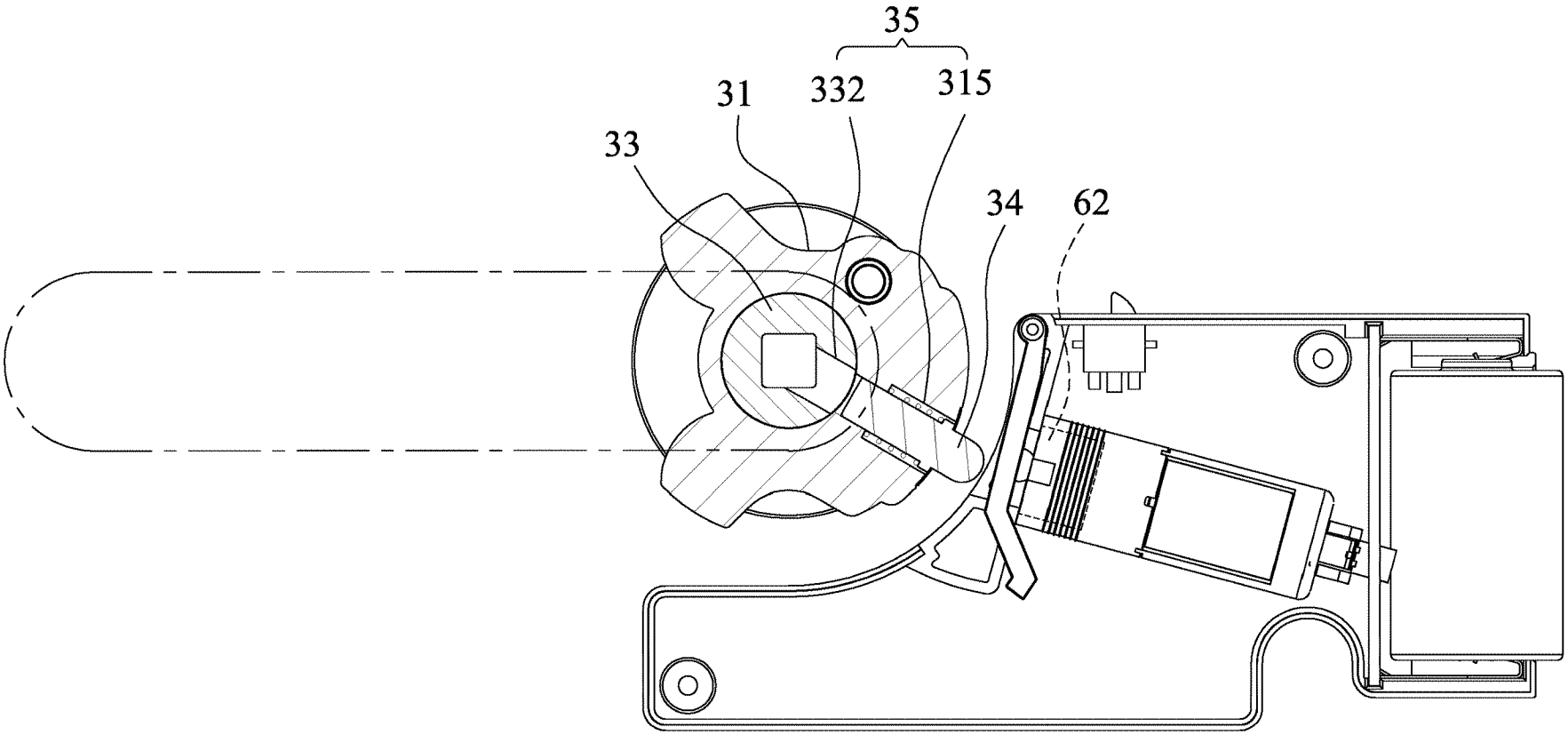
FIG. 9 is a schematic, partly sectional view illustrating an external driving member, an internal driving member and a clutch pin of the embodiment in a state when the clutch pin is in a disengaged position, and the external driving member is not rotated.

Referring to FIGS. 5, 7 and 8, the handle unit 5 includes an internal operating handle 51 and an external operating handle 52. The internal operating handle 51 has an internal driving section 511 which is configured to be in spline engagement with the external spline hole 323 of one of the driving plates 32 so as to rotate the driving plate 32 about the axis (L), and an operating section 512 which is connected with the internal driving section 511 to be manually operable. The external operating handle 52 has an external driving section 521 which is configured to extend through the external spline hole 323 of the other one of the driving plates 32 and to be in spline engagement with the internal spline hole 331 of the internal driving member 33 so as to rotate the internal driving member 33 about the axis (L), and an operating section 522 which is connected with the external driving section 521 to be manually operable.

The electric driving unit 6 has a motor 61 which is disposed in the receiving space 20, and an actuating member 62 which is driven by the motor 61 to actuate the movement of the clutch pin 34 between the engaged and disengaged positions.

With reference to FIGS. 6 to 8, in assembly, the clutch unit 3, the dead bolt unit 4 and the electric driving unit 6 are mounted in the receiving space 20 of the housing unit 2 to be of a lock structure which is assembled on a door panel (not shown) to place the driving plates 32 respectively toward interior and exterior of the door panel. Subsequently, the internal driving section 511 of the internal operating handle 51 is connected to the external spline hole 323 of the driving plate 32 toward the interior of the door panel, and the external driving section 521 of the external operating handle 52 extends through the external spline hole 323 of the driving plate 32 toward the exterior of the door panel and is connected to the internal spline hole 331 of the internal driving member 33. At this stage, the clutch pin 34 is not actuated by the actuating member 62, being placed in the disengaged position (see FIG. 9).

Figure 10:
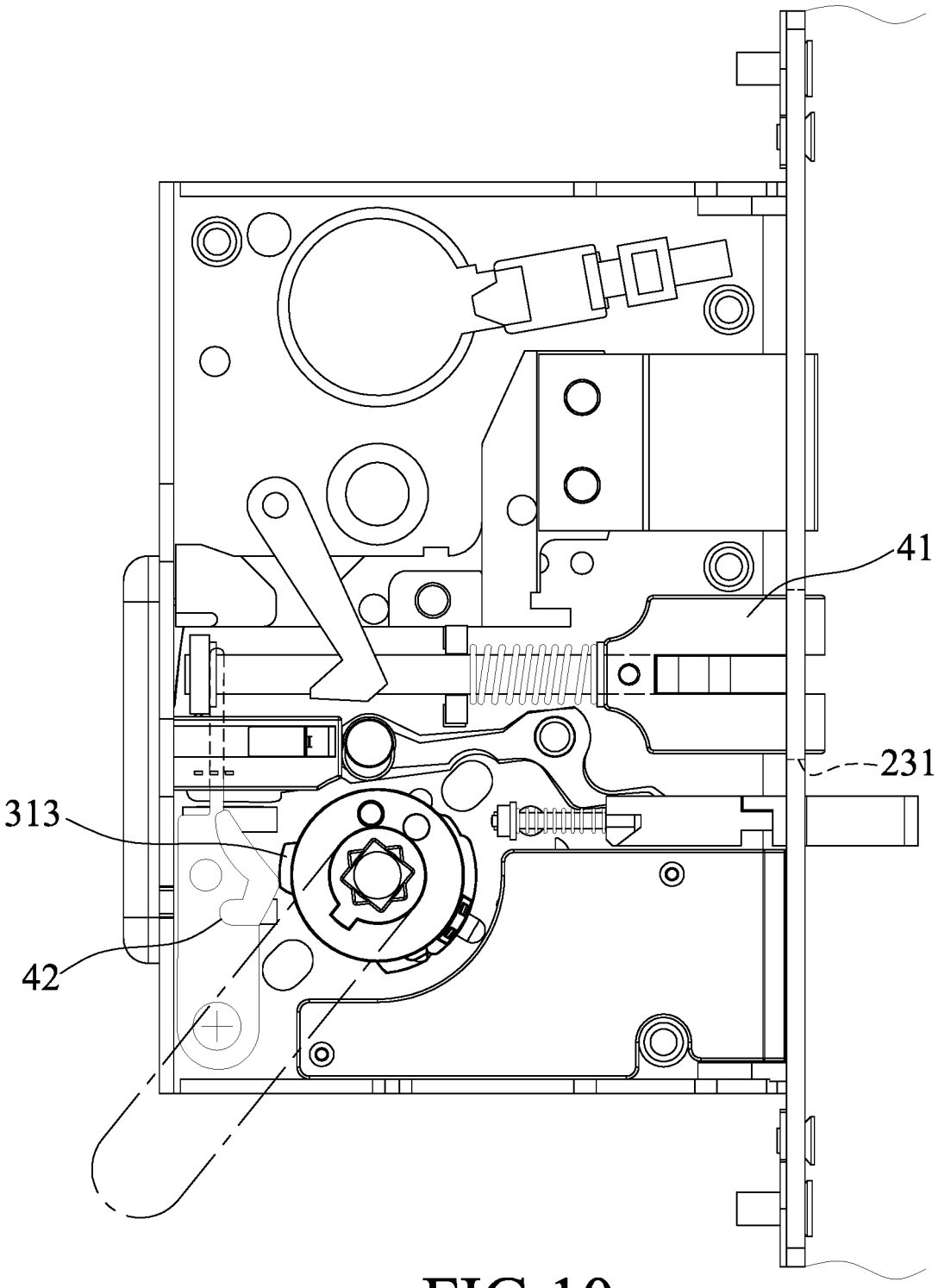
FIG. 10 is a view similar to FIG. 6, illustrating a state when the dead bolt member is in an unlatched position.
Figure 11:
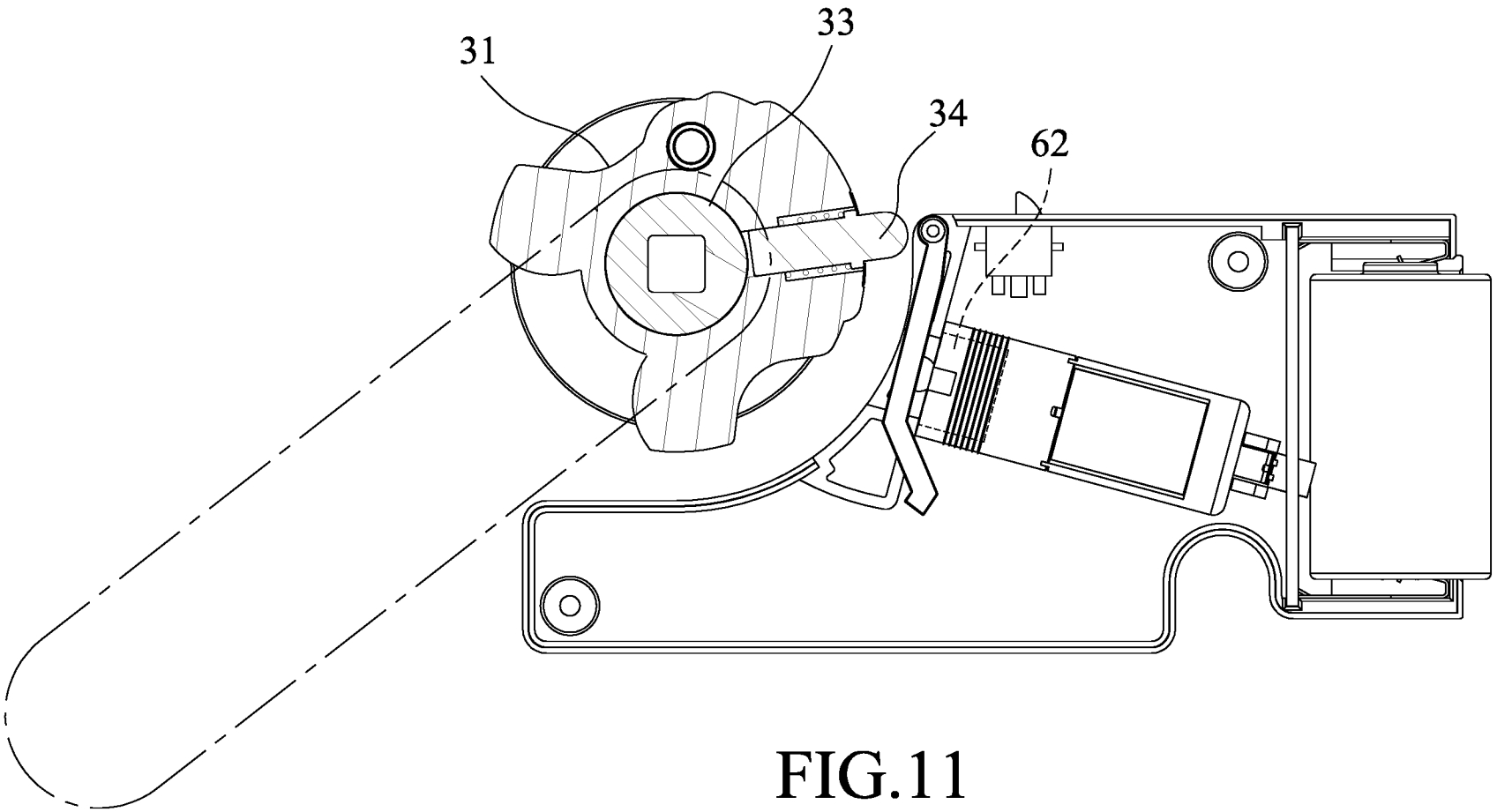
FIG. 11 is a view similar to FIG. 9, illustrating a state when the clutch pin is in the disengaged position, and the external driving member is rotated.

With reference to FIGS. 7, 10 and 11, in the state when the clutch pin 34 is in the disengaged position, with operation of the internal operating handle 51 to rotate the interior driving plate 32 and the external driving member 31, the torque is generated and transmitted to retreat the dead bolt member 41 through the transmitting module 42 so as to release the lock to allow a user located interiorly of the door panel to open the door.

In the same state, when the external operating handle 52 is operated to rotate the internal driving member 33, an idle rotation of the internal driving member 33 is made relative to the external driving member 31 such that the external driving member 31, the transmitting module 42 and the dead bolt member 41 are not driven to prevent opening door from the exterior of the door panel.

Figure 12:
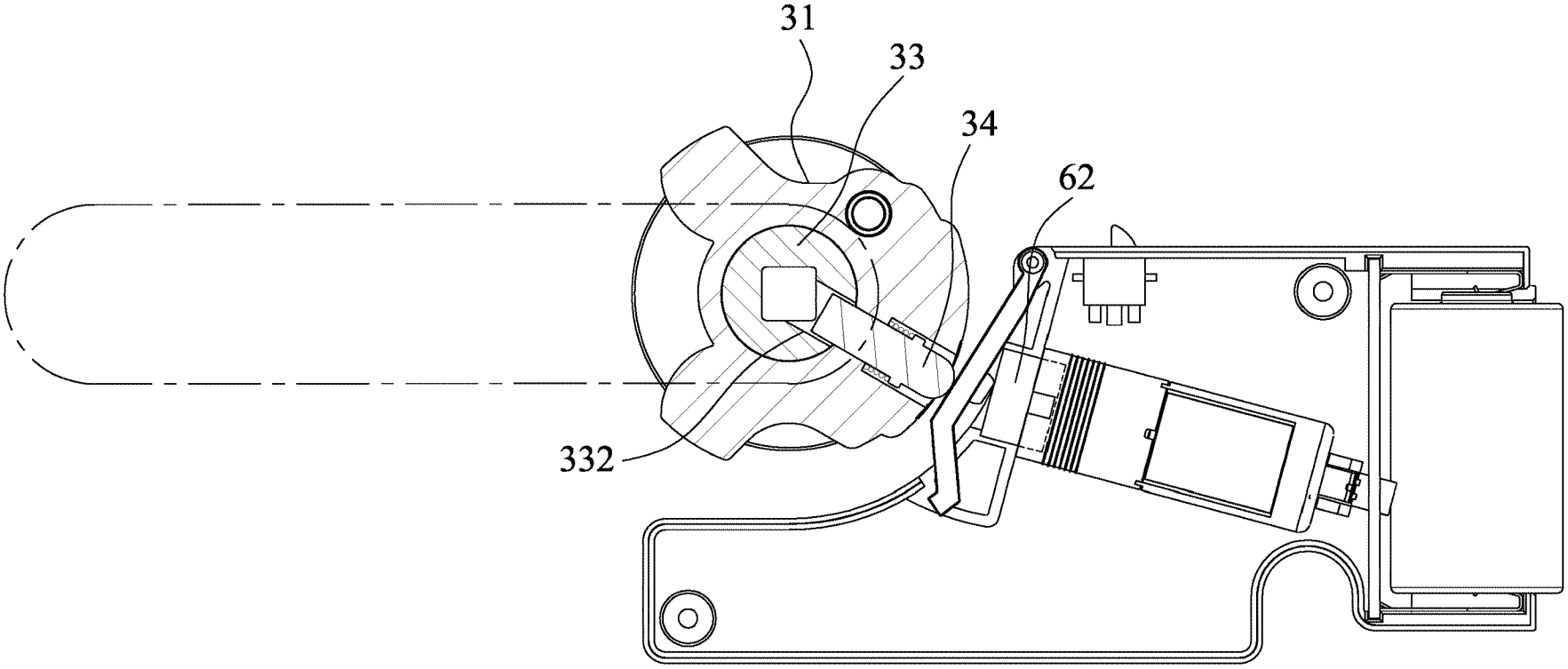
FIG. 12 is a view similar to FIG. 9, illustrating a state when the clutch pin is in an engaged position, and the internal driving member is not rotated.
Figure 13:
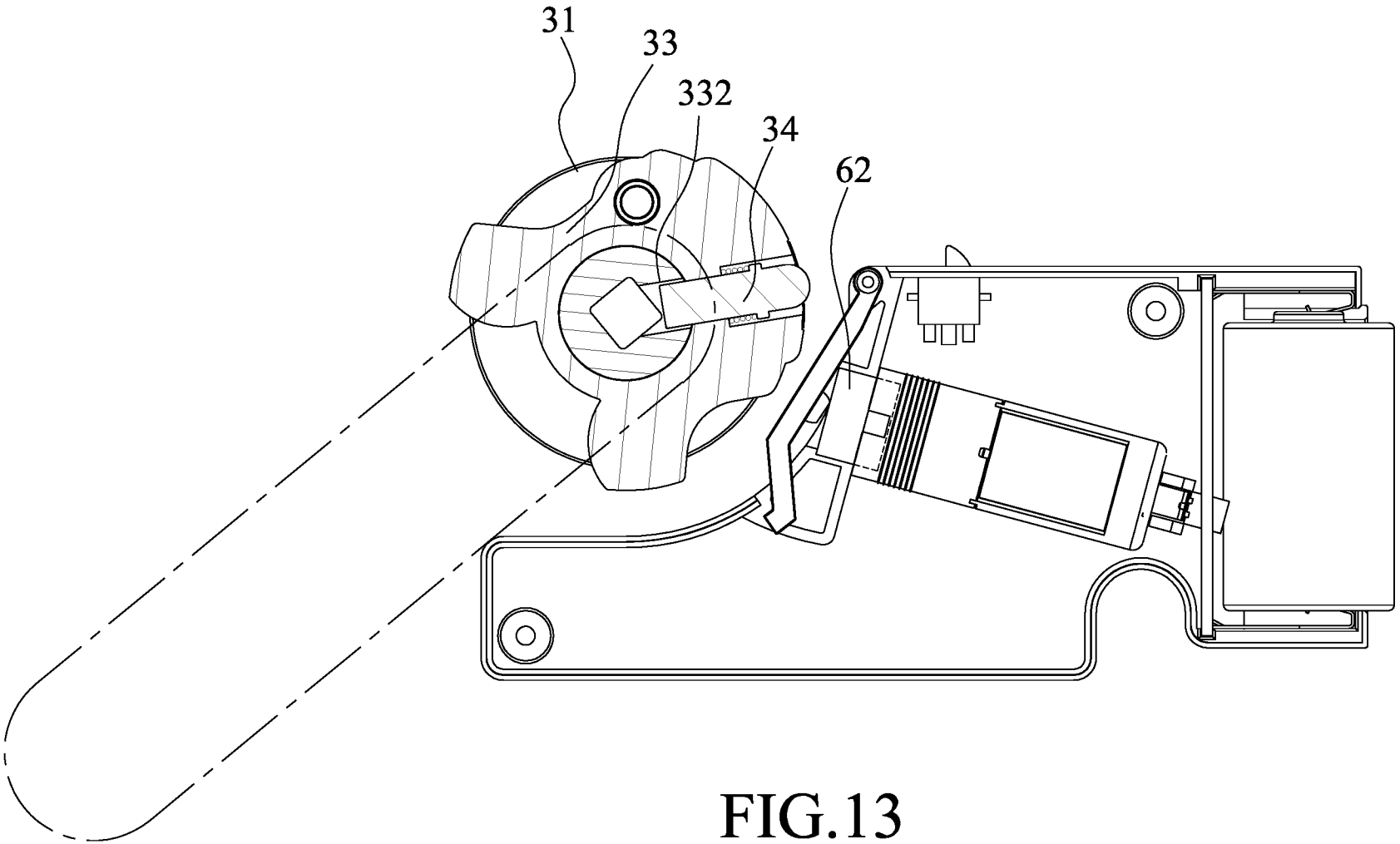
FIG. 13 is a view similar to FIG. 12, illustrating a state when the clutch pin is in the engaged position, and the internal driving member is rotated.

With reference to FIGS. 7, 12 and 13, the motor 61 is controlled to drive the actuating member 62 to actuate the movement of the clutch pin 34 to the engaged position. At this stage, the user located exteriorly of the door panel is allowed to open the door. Specifically, referring to FIGS. 7, 10 and 13, in the engaged position where the clutch pin 34 is engaged in the connecting hole 332 of the internal driving member 33, operation of the external operating handle 52 makes the synchronous rotation of the internal driving member 33 and the external driving member 31 such that the torque generated as a result of the rotation of the external driving member 31 is transmitted to retreat the dead bolt member 41 through the transmitting module 42 so as to release the lock to allow a user located exteriorly of the door panel to open the door. Meanwhile, operation of the internal operating handle 51 also causes the lock to be released.

The operation of the motor 61 can be controlled and actuated in a variety of manners, such as by an external connection lock, a wireless electric lock, etc. Since the motor 61 is of a known type, a detailed description thereof is dispensed with herein.

When it is desired to assemble the electric door lock of the embodiment to a door panel with a different opening side (e.g. the electric door lock of the embodiment is to be removed from a left-hand door to a right-hand door), the internal operating handle 51 and the external operating handle 52 are exchanged in their positions to keep the internal operating handle 51 at the interior of the door panel, and the external operating handle 52 at the exterior of the door panel. Additionally, the engaging pins 314 of the external driving member 31 can be adjusted to be engaged in the selected adjusting holes 325 of the driving plates 32 so as to vary the operating direction of the internal and external operating handles 51, 52. Thus, the reversible electric door lock can be applied to different door panels, such as a left-hand door and a right-hand door.

As illustrated, with the clutch unit 3 having the internal driving member 33 coupled with one driving plate 32 to rotate the external driving member 31, the external operating handle 52 coupled with the internal driving member 33, and the clutch pin 34 movable between the engaged position to allow the synchronous rotation of the internal and external driving members 33, 31, and the disengaged position to allow the idle rotation of the internal driving member 33 relative to the external driving member 31, the positions of the internal and external operating handles 51, 52 can be exchanged to reverse the assembling direction of the electric door lock so as to render the electric door lock suitable for different door panels.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A reversible electric door lock comprising:

a housing unit having first and second base plates spaced apart from each other in an axial direction to define a receiving space therebetween, and a lock plate disposed normal to said first and second base plates and interconnecting lateral sides of said first and second base plates, said first and second base plates respectively having first and second through holes which are aligned with each other in the axial direction, said lock plate having a bolt hole;

a clutch unit having an external driving member which is disposed in said receiving space and rotatable relative to said housing unit about an axis that extends through said first and second through holes and in the axial direction and which has two mounting sides that are opposite to each other along the axis, two driving plates which are respectively mounted on said two mounting sides of said external driving member and each of which has a pivot portion that is rotatably disposed in a respective one of said first and second through holes, and an internal driving member which is disposed in and rotatable relative to said external driving member about the axis, each of said two driving plates having an external spline hole which extends therethrough along the axis, said internal driving member having an internal spline hole which extends therethrough along the axis and which has a cross-section less than that of said external spline holes, said clutch unit further having a clutch pin which is disposed in and movable radially relative to said external driving member between an engaged position, where said clutch pin is engaged with said internal driving member so as to allow synchronous rotation of said external driving member with said internal driving member, and a disengaged position, where said clutch pin is disengaged from said internal driving member so as to allow an idle rotation of said internal driving member relative to said external driving member;

a dead bolt unit having a dead bolt member which is disposed in said receiving space and movable through said bolt hole, and a transmitting module which is disposed to transmit a torque generated as a result of rotation of said external driving member to move said dead bolt member;

an internal operating handle having an internal driving section which is configured to be in spline engagement with said external spline hole of one of said two driving plates so as to rotate said one of said two driving plates about the axis, and an operating section which is connected with said internal driving section to be manually operable;

an external operating handle having an external driving section which is configured to extend through said external spline hole of the other one of said two driving plates and to be in spline engagement with said internal spline hole of said internal driving member so as to rotate said internal driving member about the axis, and an operating section which is connected with said external driving section to be manually operable; and an electric driving unit having a motor which is disposed in said receiving space, and an actuating member which is driven by said motor to actuate movement of said clutch pin between the engaged position and disengaged position, each of said two driving plates being disposed to be adjustable relative to said external driving member in a circumferential direction around the axis.

2. The reversible electric door lock as claimed in claim 1, wherein said external driving member has a surrounding wall surrounding the axis and defining an accommodation space therein, and two driving protrusions extending radially and outwardly from said surrounding wall and angularly spaced apart from each other to be engaged with said transmitting module for transmitting the torque during the rotation of said external driving member, said surrounding wall having a communicating hole which extends radially to communicate said receiving space with said accommodation space for movably receiving said clutch pin, said internal driving member being disposed in said accommodation space and being rotatable relative to said surrounding wall, said internal driving member having a connecting hole which extends radially toward said internal spline hole to be registered with said communicating hole for defining a moving channel such that said clutch pin has a pin end movable in said moving channel to be inserted into said connecting hole for placing said clutch pin in the engaged position, and to be retreated in said communicating hole for placing said clutch pin in the disengaged position.

3. The reversible electric door lock as claimed in claim 2, wherein each of said two driving plates has a mounting portion which is opposite to said pivot portion in the axial direction and which is mounted on a respective one of said two mounting sides of said external driving member, said external spline holes extending through said mounting portion and said pivot portion, said pivot portion being configured to be journalled in the respective one of said first and second through holes to orient the rotation of said two driving plates about the axis.

4. The reversible electric door lock as claimed in claim 3, wherein said first base plate has a first inner circular wall which defines said first through hole, and a first recessed portion which is recessed radially from said first inner circular wall and which extends around the axis to terminate at two stop ends, said second base plate having a second inner circular wall which defines said second through hole, and a second recessed portion which is recessed radially from said second inner circular wall and which extends around the axis to terminate at two stop ends, said first and second recessed portions being aligned with each other in the axial direction, said pivot portion being fittingly and rotatably inserted into a respective one of said first and second inner circular walls, each of said two driving plates having a limit portion which extends radially and outwardly from said pivot portion and which is slidable in a respective one of said first and second recessed portions between said stop ends.

5. A reversible electric door lock comprising:

a housing unit having first and second base plates spaced apart from each other in an axial direction to define a receiving space therebetween, and a lock plate disposed normal to said first and second base plates and interconnecting lateral sides of said first and second base plates, said first and second base plates respectively having first and second through holes which are aligned with each other in the axial direction, said lock plate having a bolt hole;

a clutch unit having an external driving member which is disposed in said receiving space and rotatable relative to said housing unit about an axis that extends through said first and second through holes and in the axial direction and which has two mounting sides that are opposite to each other along the axis, two driving plates which are respectively mounted on said two mounting sides of said external driving member and each of which has a pivot portion that is rotatably disposed in a respective one of said first and second through holes, and an internal driving member which is disposed in and rotatable relative to said external driving member about the axis, each of said two driving plates having an external spline hole which extends therethrough along the axis, said internal driving member having an internal spline hole which extends therethrough along the axis and which has a cross-section less than that of said external spline holes, said clutch unit further having a clutch pin which is disposed in and movable radially relative to said external driving member between an engaged position, where said clutch pin is engaged with said internal driving member so as to allow synchronous rotation of said external driving member with said internal driving member, and a disengaged position, where said clutch pin is disengaged from said internal driving member so as to allow an idle rotation of said internal driving member relative to said external driving member;

a dead bolt unit having a dead bolt member which is disposed in said receiving space and movable through said bolt hole, and a transmitting module which is disposed to transmit a torque generated as a result of rotation of said external driving member to move said dead bolt member;

an internal operating handle having an internal driving section which is configured to be in spline engagement with said external spline hole of one of said two driving plates so as to rotate said one of said two driving plates about the axis, and an operating section which is connected with said internal driving section to be manually operable;

an external operating handle having an external driving section which is configured to extend through said external spline hole of the other one of said two driving plates and to be in spline engagement with said internal spline hole of said internal driving member so as to rotate said internal driving member about the axis, and an operating section which is connected with said external driving section to be manually operable; and an electric driving unit having a motor which is disposed in said receiving space, and an actuating member which is driven by said motor to actuate movement of said clutch pin between the engaged position and the disengaged position, said external driving member having a surrounding wall which surrounds the axis and which defines an accommodation space therein, and two driving protrusions which extend radially and outwardly from said surrounding wall and which are angularly spaced apart from each other to be engaged with said transmitting module for transmitting the torque during the rotation of said external driving member, said surrounding wall having a communicating hole which extends radially to communicate said receiving space with said accommodation space for movably receiving said clutch pin, said internal driving member being disposed in said accommodation space and being rotatable relative to said surrounding wall, said internal driving member having a connecting hole which extends radially toward said internal spline hole to be registered with said communicating hole for defining a moving channel such that said clutch pin has a pin end movable in said moving channel to be inserted into said connecting hole for placing said clutch pin in the engaged position, and to be retreated in said communicating hole for placing said clutch pin in the disengaged position, each of said two driving plates having a mounting portion which is opposite to said pivot portion in the axial direction and which is mounted on a respective one of said two mounting sides of said external driving member, said external spline holes extending through said mounting portion and said pivot portion, said pivot portion being configured to be journalled in the respective one of said first and second through holes to orient the rotation of said two driving plates about the axis, said first base plate having a first inner circular wall which defines said first through hole, and a first recessed portion which is recessed radially from said first inner circular wall and which extends around the axis to terminate at two stop ends, said second base plate having a second inner circular wall which defines said second through hole, and a second recessed portion which is recessed radially from said second inner circular wall and which extends around the axis to terminate at two stop ends, said first and second recessed portions being aligned with each other in the axial direction, said pivot portion being fittingly and rotatably inserted into a respective one of said first and second inner circular walls, each of said two driving plates having a limit portion which extends radially and outwardly from said pivot portion and which is slidable in a respective one of said first and second recessed portions between said stop ends, each of said two driving plates being disposed to be adjustable relative to said external driving member in a circumferential direction around the axis.

6. The reversible electric door lock as claimed in claim 5, wherein each of said two driving plates has a plurality of adjusting holes spaced apart from each other in the circumferential direction, said external driving member having two engaging pins which are telescopically disposed on said two mounting sides, respectively, in the axial direction, and each of which is engaged in a selected one of said plurality of adjusting holes of a respective one of said two driving plates so as to position a respective one of said two driving plates to said external driving member.

* * * * *